US005245981A

United States Patent [19]

Morrison

[11] Patent Number: 5,245,981

[45] Date of Patent: Sep. 21, 1993

[54] CROSSBOW TRAJECTORY COMPENSATION APPARATUS

[75] Inventor: David E. Morrison, Homosassa, Fla.

[73] Assignee: Saxon International, Inc., Tarpon Springs, Fla.

[21] Appl. No.: 866,448

[22] Filed: Apr. 10, 1992

[51] Int. Cl.[5] ..... F41B 5/12

[52] U.S. Cl. ..... 124/25; 124/86

[58] Field of Search ..... 124/22, 25, 81, 83, 124/86

[56] References Cited

U.S. PATENT DOCUMENTS

| | | | |
|---|---|---|---|
| 2,500,509 | 3/1950 | Bailey | 124/25 |
| 3,483,857 | 12/1969 | Jones | 124/25 |
| 3,581,729 | 6/1971 | Jones | 124/25 |
| 4,206,740 | 6/1980 | Lydon | 124/25 |
| 4,258,689 | 3/1981 | Barnett | 124/25 |
| 4,722,318 | 2/1988 | Yankey | 124/25 |
| 4,860,719 | 8/1989 | Scheiterlein | 124/25 |

*Primary Examiner*—Randolph A. Reese
*Assistant Examiner*—John Ricci
*Attorney, Agent, or Firm*—Basile and Hanlon

[57] ABSTRACT

A trajectory compensation apparatus is disclosed for use with a crossbow having a barrel, a trigger portion and a bow for use with an arrow, the arrow being shot traveling along a crossbow trajectory curve. The compensation apparatus comprises a rear sight mounted on the barrel at a location adjacent the trigger portion, and a forward sight is mounted on the barrel at a location adjacent the bow. A mechanism, operatively acting on the shot arrow, is provided for compensating for the trajectory curve, wherein, as the crossbow is aimed directly at a target, the arrow being shot from the bow will travel along the compensating mechanism at a predetermined upward angular orientation relative to the barrel. The arrow will then be released at a point above the target sight, thereby causing the arrow to drop onto the target at a point along the crossbow trajectory curve.

8 Claims, 1 Drawing Sheet

CROSSBOW TRAJECTORY COMPENSATION APPARATUS

BACKGROUND OF THE INVENTION

1. Field of the Invention

The present invention relates generally to hunting crossbows, and more particularly to a crossbow having a trajectory compensation apparatus.

2. Description of the Relevant Art

Several drawbacks are associated with conventional crossbows due to the very curved trajectory of a crossbow bolt or arrow. One of these disadvantages is that the user must "hold-over" when shooting at a target. To "hold-over" means that the crossbow actually must be pointed above the target in order for the bolt to climb first and then drop on to the target at a point along the crossbow trajectory curve. This leads to unnatural and inaccurate aiming, further leading to arrows having a lesser range.

Another drawback is that, with conventional crossbows having only one forward sight, any time the hunter wishes to aim at a more distant target, he must reset or further adjust the sighting system. This can lead to frustration, and even danger, due to the speed and agility of the prey.

Yet another drawback comes from "dry firing." This is caused by the bow limbs continuing to accelerate until they are abruptly halted by the bow string when discharged. Dry firing causes unwanted noise and an unsafe shock failure.

Thus, it would be desirable to provide a crossbow having a trajectory compensation apparatus which allows more natural and accurate aiming, leading to arrows having a greater range. It would further be desirable to provide such an apparatus which allows the hunter to aim at a more distant target without resetting or further adjusting the sighting system. Still further, it would be desirable to provide such an apparatus which reduces noise and allows a more gentle deceleration of the bow limbs, thereby reducing shock failure and providing a higher degree of safety.

SUMMARY OF THE INVENTION

The present invention addresses and solves all the problems enumerated above. The present invention comprises a trajectory compensation apparatus for use with a crossbow having a barrel, a trigger portion and a bow for use with an arrow, the arrow being shot traveling along a crossbow trajectory curve. The compensation apparatus comprises a rear sight mounted on the barrel at a location adjacent the trigger portion, and a forward sight is mounted on the barrel at a location adjacent the bow. Means, operatively acting on the shot arrow, are provided for compensating for the trajectory curve, wherein, as the crossbow is aimed directly at a target, the arrow being shot from the bow will travel along the compensating means at a predetermined upward angular orientation relative to the barrel. The arrow will then be released at a point above the target sight, thereby causing the arrow to drop onto the target at a point along the crossbow trajectory curve.

BRIEF DESCRIPTION OF THE DRAWINGS

Other objects and features of the present invention will become apparent by reference to the following detailed description and drawings, in which.

DETAILED DESCRIPTION OF THE PREFERRED EMBODIMENTS

Figure 1:
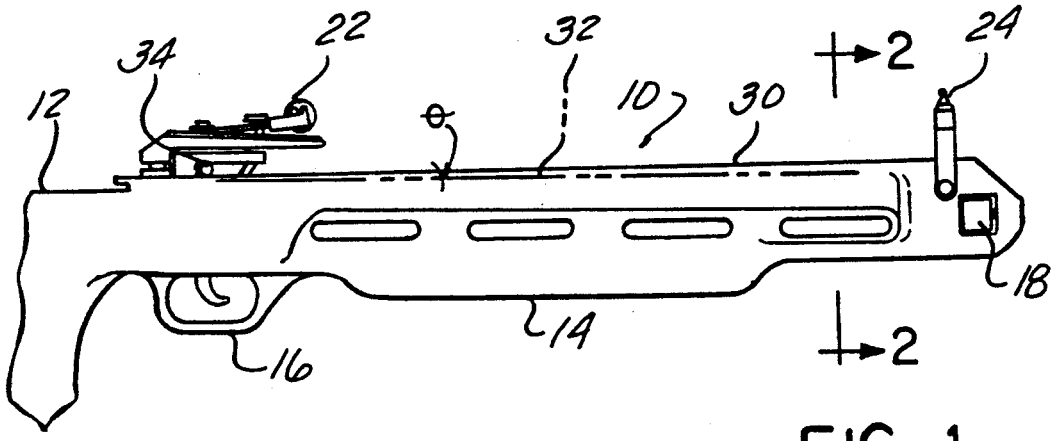
FIG. 1 is a partially cutaway and partially cross sectioned side view of a crossbow having a trajectory compensation apparatus of the present invention.
Figure 3:
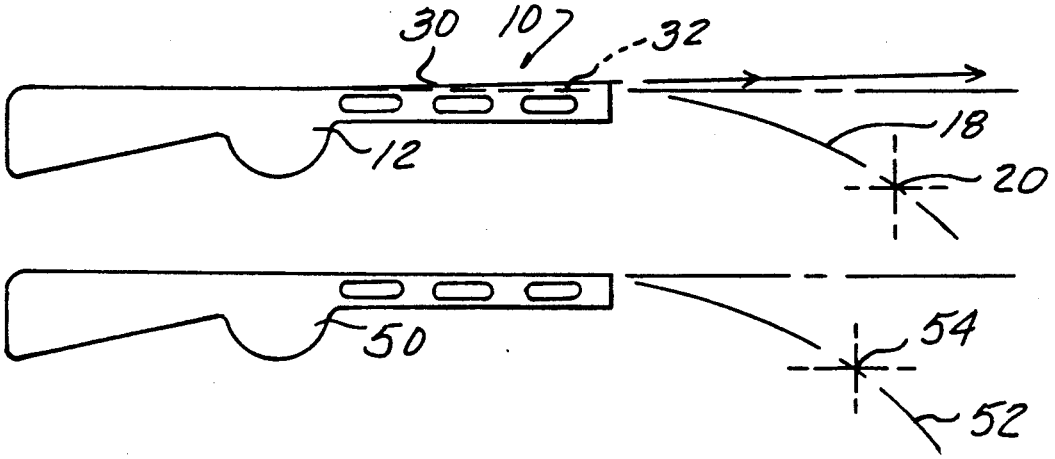
FIG. 3 is a schematic view showing the crossbow trajectory curves of both a crossbow having the compensation apparatus and a conventional crossbow.

Referring now to FIG. 1, the trajectory compensation apparatus, which can be used with any type of crossbow including pistol crossbows, is designated generally as 10. The compensation apparatus 10 is for use with a crossbow 12 having a barrel 14, a trigger portion 16 and a bow 18 for use with a bolt or arrow (not shown). The arrow being shot travels along a crossbow trajectory curve. As seen in FIG. 3, the bottom schematic view shows a conventional crossbow 50 having a crossbow trajectory curve 52. An arrow shot from crossbow 50 will hit a target at point 54. As shown in the upper schematic view, crossbow 12 having the compensation apparatus 10 has a crossbow trajectory curve 18. An arrow shot from this crossbow will hit a target at point 20. As can be seen, the range of crossbow 12 is farther than that of crossbow 50.

Figure 2:
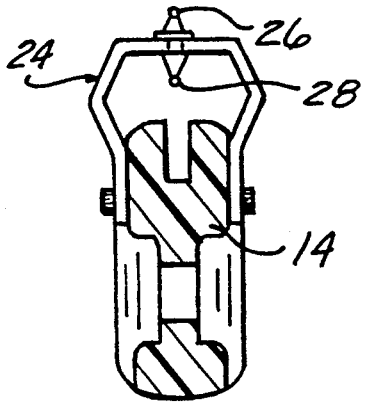
FIG. 2 is a cross sectional view taken on line 2—2 of FIG. 1 showing the dual range forward sight.

Referring back to FIG. 1, compensation apparatus 10 comprises a rear sight 22 mounted on barrel 14 at a location adjacent trigger portion 16. A forward sight 24 is mounted on barrel 14 at a location adjacent bow 18. Compensation apparatus 10 may further optionally comprise means, integral with forward sight 24, for providing a dual range forward sight. This dual range providing means may comprise any suitable means, however, in the preferred embodiment, this means comprises an upper sight 26 and a lower site 28, as best seen in FIG. 2. The upper sight 26 is used for a first target at a first distance, and lower sight 28 is used for a second target at a second distance. These distances may be set at any desired range, however in the preferred embodiment, the second distance is greater than the first distance.

Compensation apparatus 10 further comprises means, operatively acting on the shot arrow, for compensating for crossbow trajectory curve 18. This compensating means may comprise any suitable means. In the preferred embodiment, this means comprises a ramp 30 mounted to barrel 14. This ramp 30 may be attached in any conventional manner to barrel 14. For example, it may be cast, attached or molded to the launch section of the crossbow barrel 14. Ramp 30 extends outwardly and upwardly from rear sight 22 toward forward sight 24 at a predetermined upward angular orientation relative to barrel 14. As best seen in FIG. 1, the upper surface of barrel 14 is shown in phantom at 32. The lower surface of ramp 30 is attached to upper surface 32. The upward slope of ramp 30 is determined by angle $\theta$. This angle $\theta$ may be determined as specified by the customer and/or manufacturer, in order to meet any desired range and compensate for the trajectory of the particular crossbow, as well as to fit the final desired end use of the hunter.

In use, as crossbow 12 is aimed directly at a target, the arrow being shot from bow 18 will travel along the compensating mean at the predetermined upward angular orientation, and will be released at a point above the target sight, thereby causing the arrow to drop onto the target at a point 20 along the crossbow trajectory curve 18.

The trajectory compensation apparatus 10 may further optionally comprise means for preventing dry firing. This preventing means may comprise any suitable means, but in the preferred embodiment, this means comprises ramp 30 mounted to barrel 14, as described further above. In addition to functioning as described above, ramp 30 also causes an increase in the drag of bow string 34 as it travels down barrel 14. This bow string drag results in an essentially gentle deceleration of the bow limbs, which thereby reduces shock failure and provides a higher degree of safety.

Among the advantages of the present invention are that the trajectory compensation apparatus allows more natural and accurate aiming, since the crossbow 12 can be aimed directly at a target, as opposed to above the target. The shot arrows have a greater range with the present invention. In addition, the dual range forward sight allows the hunter to aim at a more distant target without resetting or further adjusting the siting system.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A trajectory compensation apparatus for use with a crossbow having a barrel, a trigger portion and a bow for use with an arrow, the arrow being shot traveling along a crossbow trajectory curve, the compensation apparatus comprising:

a rear sight mounted on the barrel at a location adjacent the trigger portion;

a forward sight mounted on the barrel at a location adjacent the bow; and means, operatively acting on the shot arrow, for compensating for the trajectory curve;

wherein, as the crossbow is aimed directly at a target, the arrow being shot from the bow will travel along the compensating means at a predetermined upward angular orientation relative to the barrel, and will be released at a point above the target, thereby causing the arrow to drop onto the target at a point along the crossbow trajectory curve.

2. The trajectory compensation apparatus as defined in claim 1 wherein the compensating means comprises a ramp mounted to the barrel, the ramp extending outwardly and upwardly from the rear sight toward the forward sight, at the predetermined angular orientation.

3. The trajectory compensation apparatus as defined in claim 1, further comprising means, integral with the forward sight, for providing a dual range forward sight.

4. The trajectory compensation apparatus as defined in claim 3 wherein the dual range providing means comprises an upper sight and a lower sight, the upper sight being used for a first target at a first distance, and the lower sight being used for a second target at a second distance.

5. The trajectory compensation apparatus as defined in claim 4 wherein the second distance is greater than the first distance.

6. The trajectory compensation apparatus as defined in claim 1, further comprising means for preventing dry firing.

7. The trajectory compensation apparatus as defined in claim 6 wherein the bow has bow limbs and an associated bowstring, and wherein the dry firing preventing means comprises a ramp mounted to the barrel, the ramp extending outwardly and upwardly from the rear sight toward the forward sight, at a predetermined angular orientation relative to the barrel, wherein the ramp causes an increase in bowstring drag as the bowstring travels down the barrel, the bowstring drag resulting in an essentially gentle deceleration of the bow limbs.

8. A trajectory compensation apparatus for use with a crossbow having a barrel, a trigger portion and a bow for use with an arrow, the arrow being shot traveling along a crossbow trajectory curve, the compensation apparatus comprising:

a rear sight mounted on the barrel at a location adjacent the trigger portion;

a forward sight mounted on the barrel at a location adjacent the bow;

means, integral with the forward sight, for providing a dual range forward sight, wherein the dual range providing means comprises:

an upper sight; and a lower sight;

wherein the upper sight is used for a first target at a first distance, and the lower sight is used for a second target at a second distance; and means, operatively acting on the shot arrow, for compensating for the trajectory curve, wherein the compensating means comprises:

a ramp mounted to the barrel, the ramp extending outwardly and upwardly from the rear sight toward the forward sight, at a predetermined angular orientation relative to the barrel;

wherein, as the crossbow is aimed directly at a target, the arrow being shot from the bow will travel along the ramp at the predetermined upward angular orientation, and will be released at a point above the target, thereby causing the arrow to drop onto the target at a point along the crossbow trajectory curve.

* * * * *